US011253039B1

(12) United States Patent
Lei et al.

(10) Patent No.: US 11,253,039 B1
(45) Date of Patent: Feb. 22, 2022

(54) WIRELESS BLOW DRYER

(71) Applicant: SHENZHEN CARKU TECHNOLOGY CO., LIMITED, Guangdong (CN)

(72) Inventors: Yun Lei, Guangdong (CN); Chuwei Liu, Guangdong (CN); Yubin Zhang, Guangdong (CN)

(73) Assignee: SHENZHEN CARKU TECHNOLOGY CO., LIMITED, Shenzhen (CN)

( * ) Notice: Subject to any disclaimer, the term of this patent is extended or adjusted under 35 U.S.C. 154(b) by 0 days.

(21) Appl. No.: 17/318,652

(22) Filed: May 12, 2021

(30) Foreign Application Priority Data

Nov. 10, 2020 (CN) ..... 202011251313.6
Nov. 10, 2020 (CN) ..... 202022593049.6

(51) Int. Cl.
*A45D 20/12* (2006.01)

(52) U.S. Cl.
CPC ..... *A45D 20/12* (2013.01)

(58) Field of Classification Search
CPC ..... A45D 20/00; A45D 20/12; F04D 29/00; F04D 29/688
USPC ..... 34/95–100
See application file for complete search history.

(56) References Cited

U.S. PATENT DOCUMENTS 4,635,382 A * 1/1987 Bourdeau ..... A45D 20/06 126/401
4,800,654 A * 1/1989 Levin ..... A45D 1/02 126/401
5,074,006 A * 12/1991 Eremita ..... A01K 13/002 15/344
5,608,975 A * 3/1997 Hsu ..... A45D 20/06 34/96
6,449,870 B1 * 9/2002 Perez ..... A45D 20/12 34/96
7,065,899 B2 * 6/2006 Lin ..... F24H 3/0488 34/97
7,356,942 B2 * 4/2008 Lin ..... F24H 3/0488 34/96
7,913,416 B1 * 3/2011 Scieri ..... A45D 20/10 34/97

(Continued)

FOREIGN PATENT DOCUMENTS

EP 2255692 A1 12/2010
EP 3506790 B1 * 9/2020 ..... H01M 10/0525

(Continued)

OTHER PUBLICATIONS

The Extended European Search Report issued in corresponding EP Application No. EP21175459.3, dated Nov. 15, 2021.

*Primary Examiner* — Stephen M Gravini
(74) *Attorney, Agent, or Firm* — Hauptman Ham, LLP

(57) ABSTRACT

The present disclosure provides a wireless blow dryer, which includes an air duct, a handle connected to the air duct, an energy storage assembly, a fan assembly, and an air inlet channel and an air outlet channel communicating with each other. The air duct is provided with the air outlet channel. The energy storage assembly includes at least one energy storage module arranged in the air duct. The fan assembly is arranged in the air inlet channel. The fan assembly is configured to cause airflow to enter the air inlet channel and out of the air duct through the air outlet channel when the fan assembly works.

20 Claims, 12 Drawing Sheets

(56) References Cited

U.S. PATENT DOCUMENTS

| | | | | |
|---|---|---|---|---|
| 9,756,922 | B1 * | 9/2017 | Duthe | A45D 20/12 |
| 9,930,950 | B1 * | 4/2018 | Cage | A45D 20/12 |
| 9,986,810 | B2 * | 6/2018 | Bobillier | A45D 20/08 |
| 10,021,951 | B2 * | 7/2018 | Bobillier | A45D 20/12 |
| 10,080,414 | B2 * | 9/2018 | Douglas | F16M 13/02 |
| 10,165,843 | B2 * | 1/2019 | Hedges | A45D 20/12 |
| 10,226,112 | B2 * | 3/2019 | Kerr | A45D 20/04 |
| 10,441,049 | B2 * | 10/2019 | Douglas | A45D 20/12 |
| 10,441,050 | B2 * | 10/2019 | Blanc | A45D 20/12 |
| 11,013,376 | B2 * | 5/2021 | Yoo | A45D 20/14 |
| 11,033,088 | B2 * | 6/2021 | Atkinson | B01D 46/0005 |
| 2006/0227491 | A1 | 10/2006 | Rosati et al. | |
| 2018/0055182 | A1 | 3/2018 | Fairholm et al. | |
| 2019/0142132 | A1 * | 5/2019 | Nelson | H01M 10/486 34/96 |

FOREIGN PATENT DOCUMENTS

| | | | | |
|---|---|---|---|---|
| GB | 2543751 | B * | 4/2019 | H02K 5/24 |
| JP | 6512713 | B2 * | 5/2019 | F24H 3/0423 |
| JP | 6739855 | B2 * | 8/2020 | A45D 20/12 |
| KR | 20190117859 | A | 10/2019 | |
| WO | WO-2017068322 | A1 * | 4/2017 | H02K 5/24 |

* cited by examiner

WIRELESS BLOW DRYER

CROSS-REFERENCE TO RELATED APPLICATION(S)

The present disclosure claims priority to and the benefit of Chinese Patent Application No. 202011251313.6 and 202022593049.6, filed on Nov. 10, 2020, the entire disclosure of which are hereby incorporated by reference in their entireties.

TECHNICAL FIELD

The present disclosure relates to the technology field of blow dryers, and in particular to a wireless blow dryer.

BACKGROUND

Existing blow dryers generally include a handle and an air duct arranged at one end of the handle. The air duct is provided with an electric heating assembly and a fan assembly, and the handle is provided with a rechargeable battery. The rechargeable battery is coupled to the electric heating assembly and the fan assembly through wires. One end of the air duct is provided with an air inlet, and an opposite end of the air duct is provided with an air outlet. Rotation of the fan causes airflow to flow in from the air inlet, and then discharge from the air outlet after passing through the air duct. However, the wires inside the existing blow dryer block part of the airflow, thereby affecting the flow of the airflow in the air duct.

SUMMARY

The purpose of the present disclosure is to provide a wireless blow dryer through which air can flow smoothly and unimpeded.

In order to solve the above technical problems, the present disclosure provides a wireless blow dryer, which includes an air duct, a handle connected to the air duct, an energy storage assembly, a fan assembly, and an air inlet channel and an air outlet channel communicating with each other. The air duct is provided with the air outlet channel. The energy storage assembly includes at least one energy storage module arranged in the air duct. The fan assembly is arranged in the air inlet channel. The fan assembly is configured to cause airflow to enter the air inlet channel and out of the air duct through the air outlet channel when the fan assembly works.

BRIEF DESCRIPTION OF THE DRAWINGS

In order to illustrate the technical solutions of the embodiments of the present disclosure more clearly, the accompanying drawings that need to be used in the embodiments will be briefly introduced below. Obviously, the accompanying drawings described below are merely some embodiments of the present disclosure. For those skilled in the art, other drawings can also be obtained based on these accompanying drawings without paying creative work.

DETAILED DESCRIPTION

The technical solutions in the embodiments of the present application will be described clearly and completely in combination with the accompanying drawings in the embodiments of the present application. Obviously, the described embodiments are only part of the embodiments of the present application, rather than all the embodiments. Based on the embodiments in the present disclosure, all other embodiments obtained by those of ordinary skill in the art without making creative work shall fall within the protection scope of the present disclosure.

In the description of the embodiments of the present disclosure, it should be understood that the orientation or positional relationship indicated by the term "thickness" is based on the orientation or positional relationship shown in the accompanying drawings, and is only for the convenience of describing the present disclosure and simplifying the description, rather than implying that the device or element referred to must have a specific orientation, be constructed and operated in a specific orientation, and therefore cannot be understood as a limitation of the present disclosure.

Figure 4:
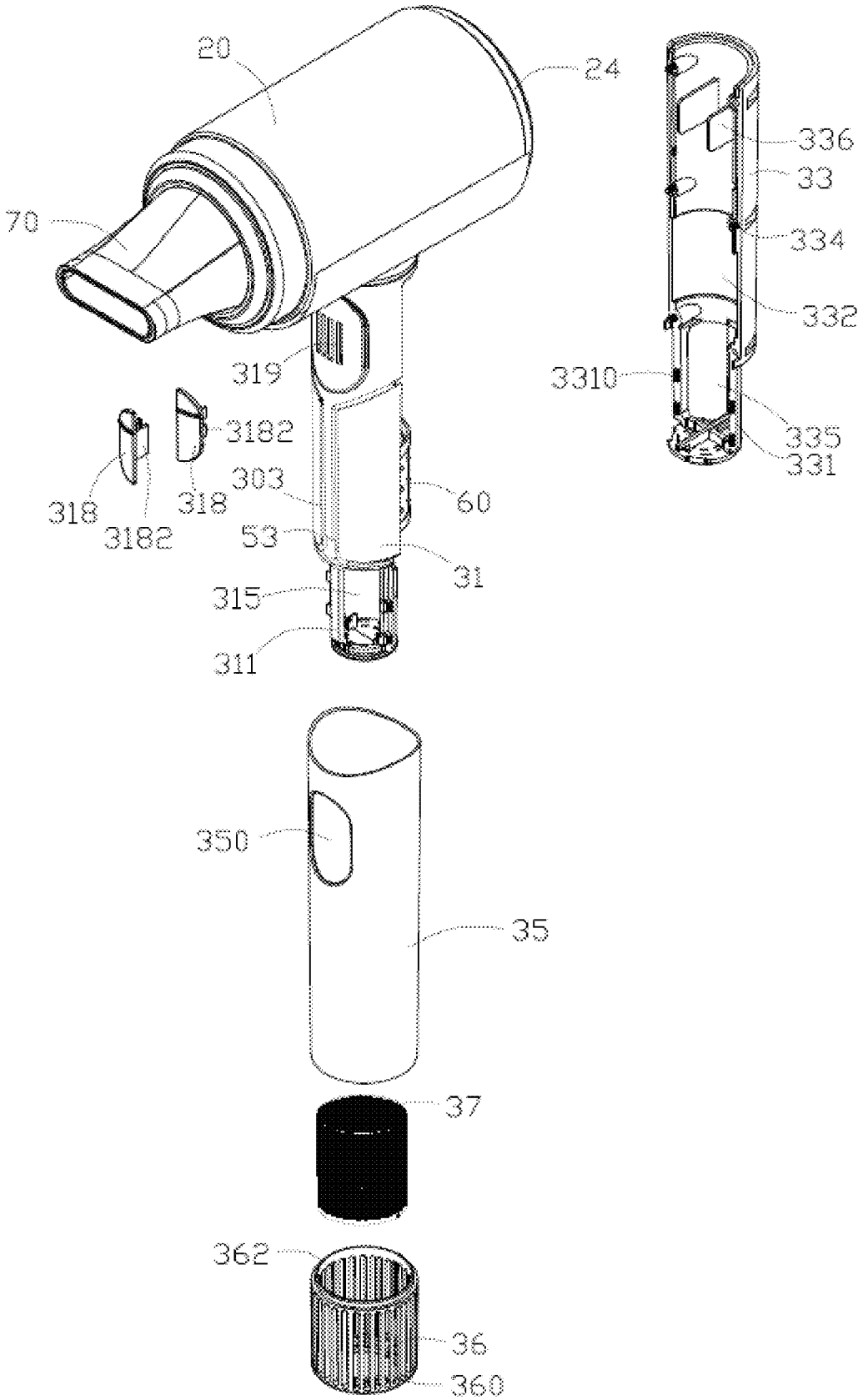
FIG. 4 is a further exploded schematic diagram of the three-dimensional structure of the handle of the wireless blow dryer illustrated in FIG. 2.
Figure 5:
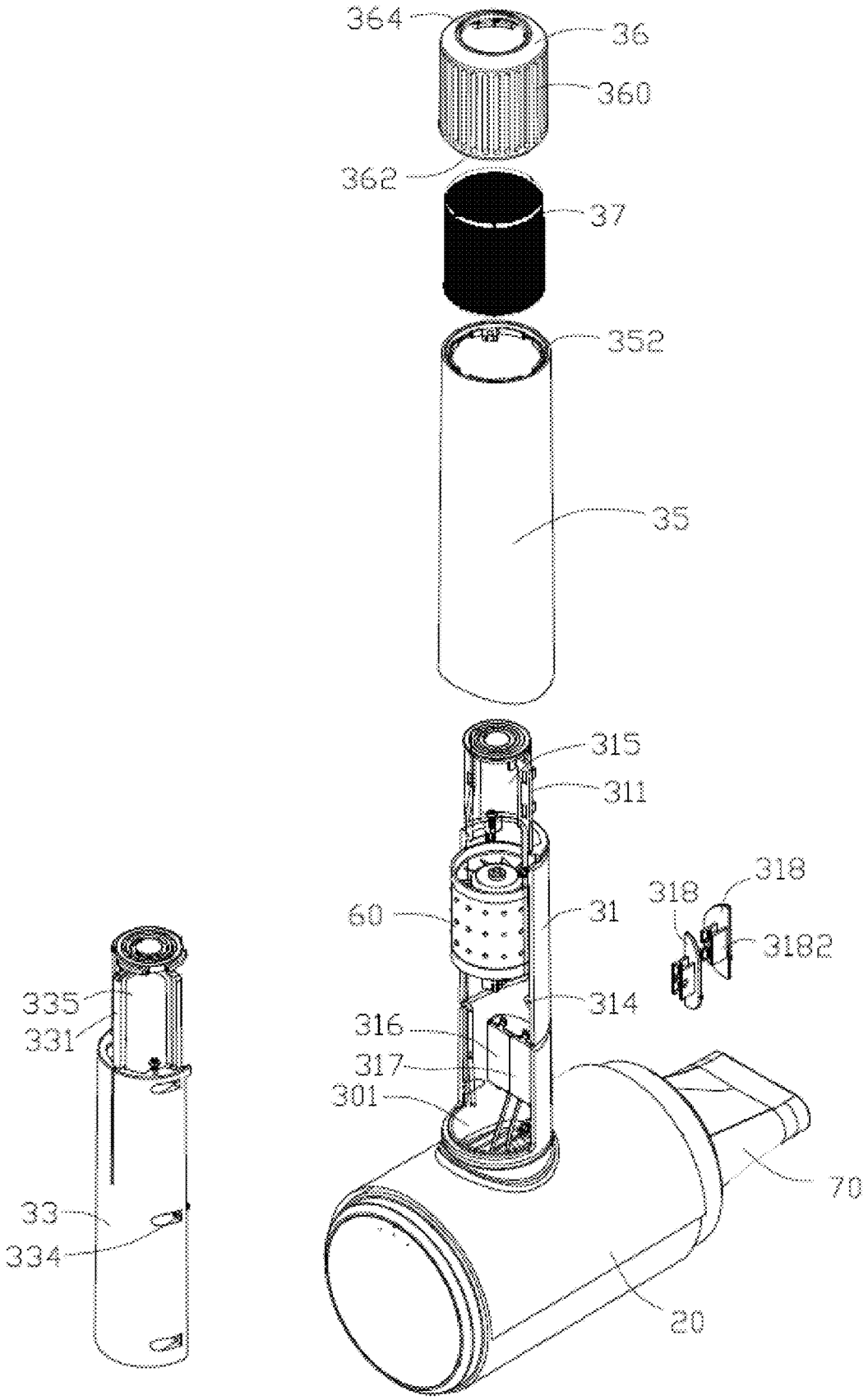
FIG. 5 is a schematic diagram of the three-dimensional structure of the wireless blow dryer illustrated in FIG. 4 from another perspective.
Figure 6:
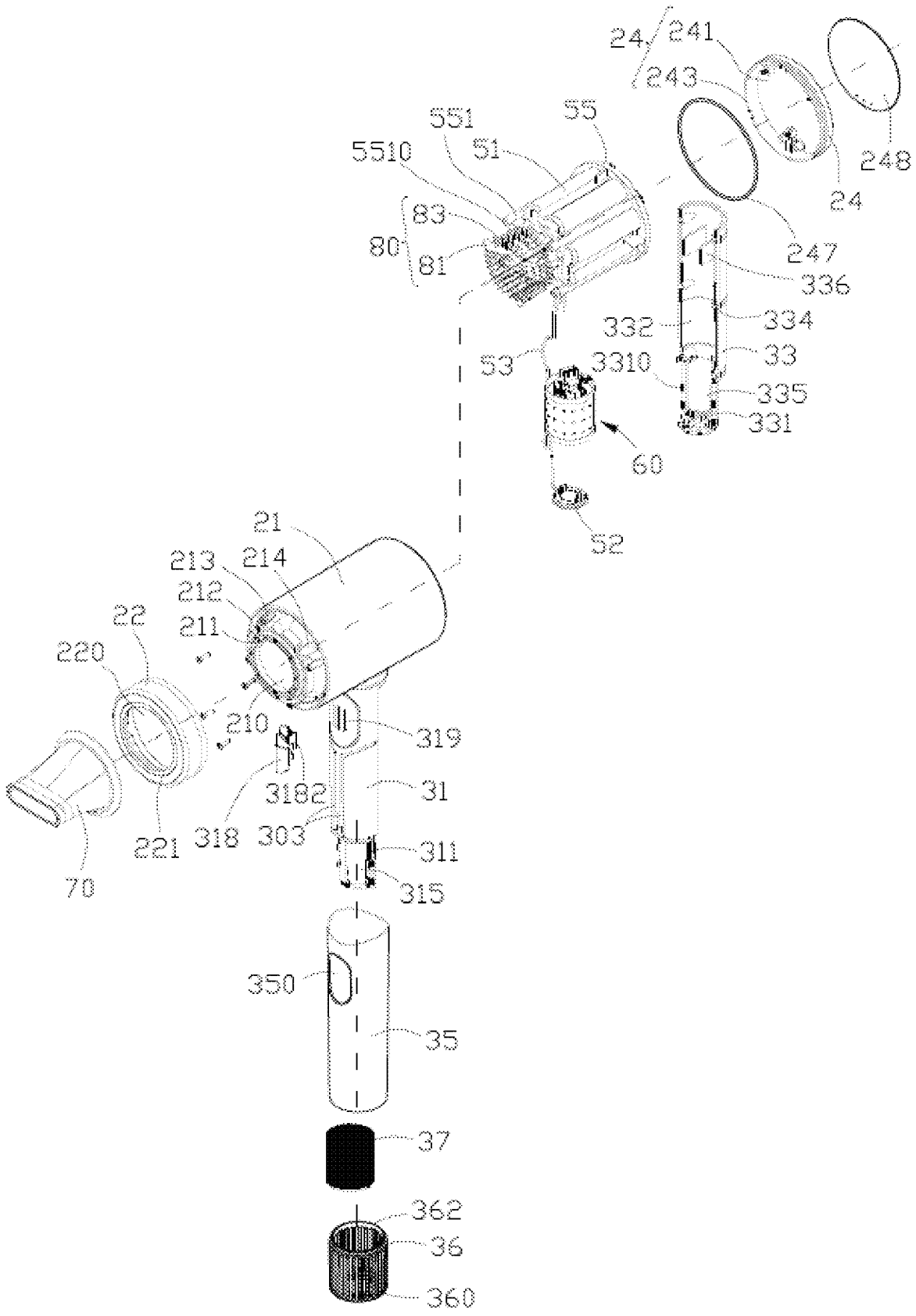
FIG. 6 is a further exploded schematic diagram of the three-dimensional structure of the wireless blow dryer illustrated in FIG. 2.
Figure 7:
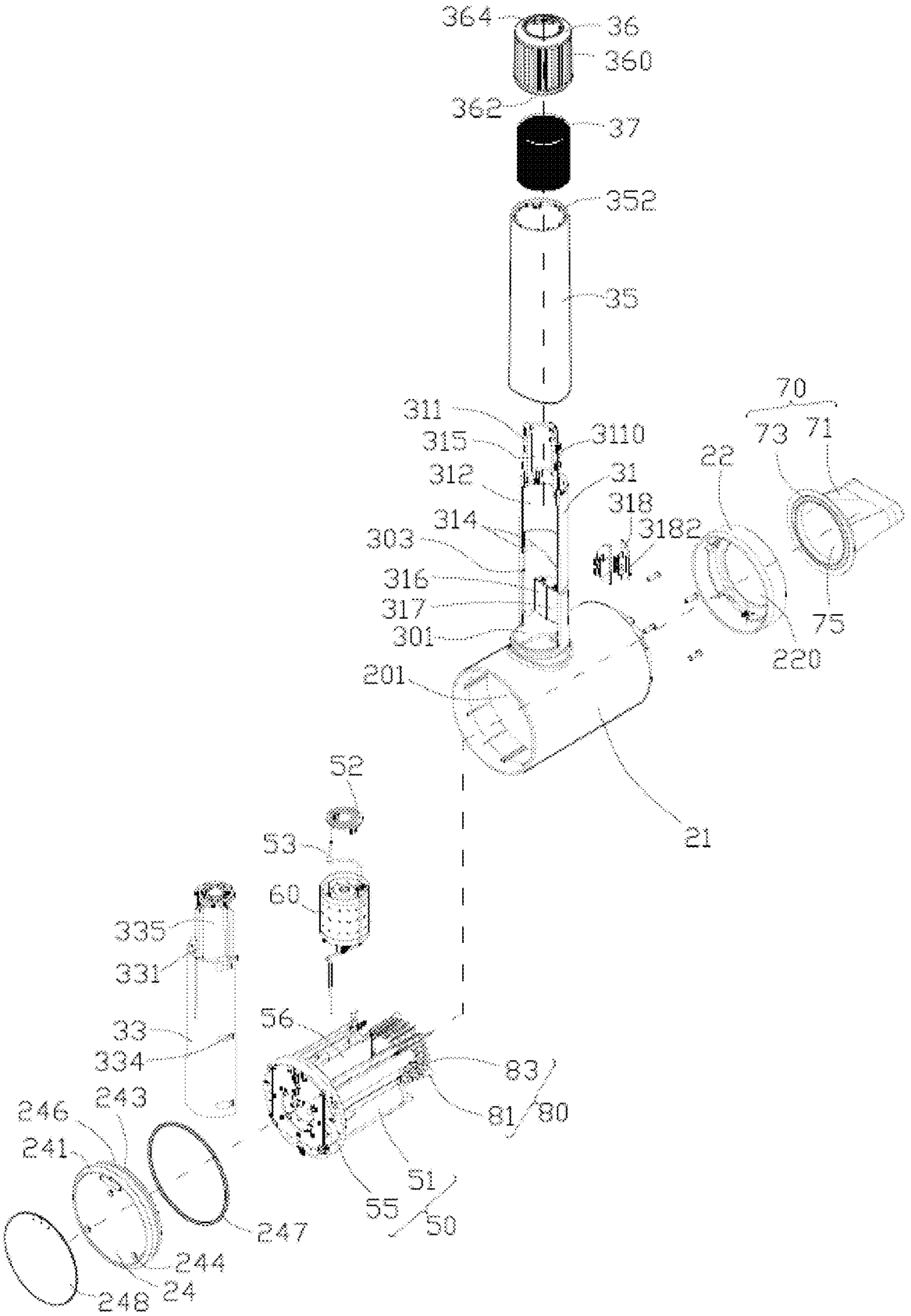
FIG. 7 is an exploded schematic diagram of the three-dimensional structure of the wireless blow dryer illustrated in FIG. 6 from another perspective.

Please refer to FIG. 1 to FIG. 7, the present disclosure provides a wireless blow dryer 100. The wireless blow dryer 100 includes an air duct 20, a handle 30 connected to the air duct 20, an energy storage assembly 50, a fan assembly 60, and an electric heating assembly 80. As illustrated in FIG. 6 and FIG. 7, the air duct 20 is provided with an air outlet channel 201, and the handle 30 is provided with an air inlet channel 301 communicating with the air outlet channel 201. The energy storage assembly 50 includes a plurality of energy storage modules 51 arranged in the air duct 20, a charging connector 52 arranged at a free end of the handle 30, and wires 53 coupled between the energy storage modules 51 and the charging connector 52. The wires 53 are arranged in a side wall of the handle 30. The fan assembly 60 is arranged in the air inlet channel 301 of the handle 30. The fan assembly 60 is configured to cause airflow to enter the air inlet channel 301 and out of the air duct 20 through the air outlet channel 201 when the fan assembly 60 works. The electric heating assembly 80 is arranged in the air outlet channel 201 to provide the user with hot airflow. The energy storage module 51 may include, but is not limited to, a rechargeable battery, an energy storage capacitor, etc. In the present disclosure, the energy storage module 51 is a rechargeable battery.

In the wireless blow dryer 100 provided by the present disclosure, the rechargeable batteries 51 are arranged in the air duct 20, the charging connector 52 is arranged at the free end of the handle 30, and the wires 53 coupled between the rechargeable batteries 51 and the charging connector 52 are arranged in the side wall of the handle 30, the fan assembly 60 is arranged in the air inlet channel 301 of the handle 30, and the fan assembly 60 causes airflow to enter the air inlet channel 301 and out of the air duct 20 through the air outlet channel 201 when the fan assembly 60 works. Since the wires 53 do not occupy the space of the air inlet channel 301, the wires 53 will not block the airflow caused by the fan assembly 60, which can keep the air inlet channel 301 smooth, so that the wind pressure provided by the wireless blow dryer 100 is stronger and more concentrated, and the work efficiency is higher, which improves the user experience.

Figure 8:
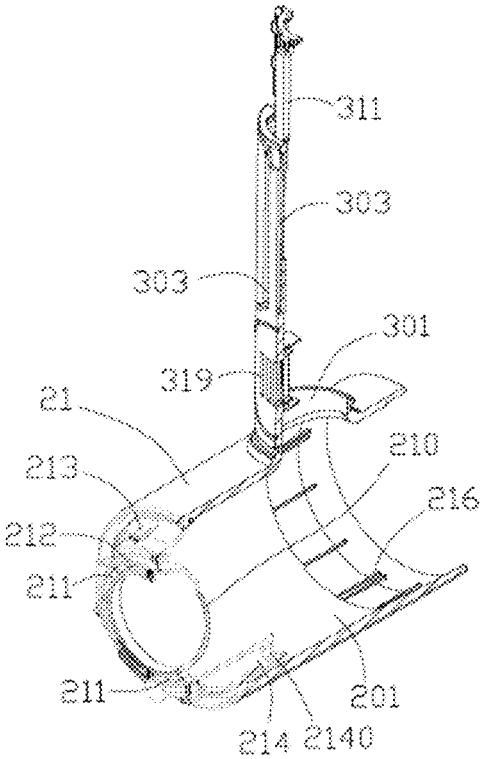
FIG. 8 is a partial cross-sectional view of the three-dimensional structure of a main housing of the wireless blow dryer illustrated in FIG. 7.
Figure 9:
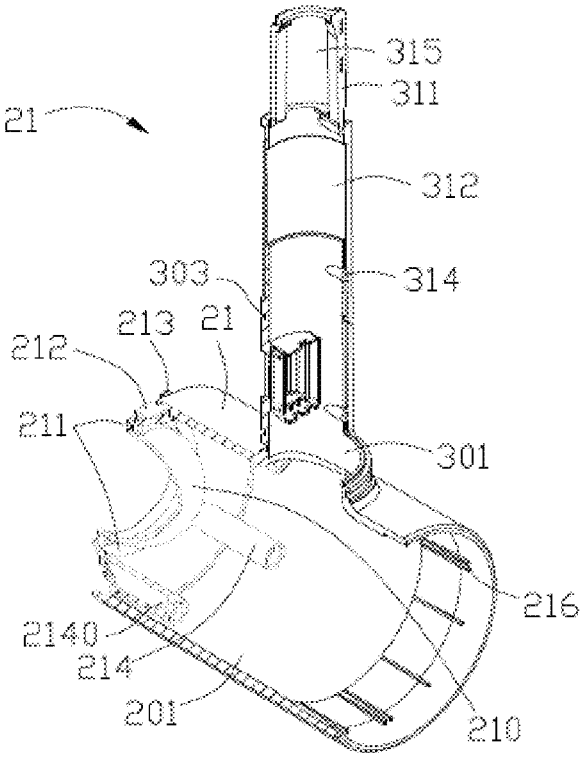
FIG. 9 is a three-dimensional structural diagram of the main housing illustrated in FIG. 8 from another perspective.

The air duct 20 includes a hollow main housing 21, a front housing 22 arranged at a front end of the main housing 21, and a rear cover 24 arranged at a rear end of the main housing 21. The air outlet passage 201 penetrates the main housing 21 along an axial direction of the main housing 21. In this embodiment, the main housing 21 is substantially cylindrical in shape. In other embodiments, the main housing 21 may also be rectangular, elliptical, polygonal, etc., in shape. The main housing 21 is provided with an air guiding element 210 at a front end of the air outlet channel 201. Specifically, as illustrated in FIG. 6, FIG. 8 and FIG. 9, the air guiding element 210 is a hemispherical structure that is provided at the front end of the main housing 21 and is concave toward the rear end of the main housing 21 along the axial direction of the main housing 21 in the air outlet channel 201. The main housing 21 is provided, at its front end, with an air outlet 211 communicating with the air outlet channel 201 and around the air guiding element 210. In the present embodiment, the air guide 210 is configured to guide the airflow in the air outlet channel 201 to the side wall of the air outlet channel 201, so that the airflow is concentrated and discharged from the air duct 21 through the air outlet 211, thereby further increasing the strength of the wind pressure provided by the wireless blow dryer 100. The main housing 21 is provided with a snapping ring 212 protruding from the front end of the main housing 21 along the axial direction of the main housing 21 and around the air outlet 211, and the front housing 22 is sleeved on the snapping ring 212, so that the front housing 22 can be connected to the main housing 21. In the present disclosure, the front end refers to one end of the wireless blow dryer 100 that faces the user during normal use, and the rear end refers to one end of the wireless blow dryer 100 that is away from the user during normal use.

The main housing 21 is provided, at its front end, with a plurality of connecting columns 213 around the snapping ring 212. The connecting columns 213 are configured to connect the front housing 22 to the main housing 21. Specifically, an axial direction of the connecting column 213 is parallel to that of the main housing 21. Each connecting column 213 is provided with a locking hole (not illustrated) along its axial direction, and the front housing 22 is provided with mounting holes (not illustrated) corresponding to the locking holes on the connecting columns 213. In assembly, for each connecting columns 213, a locking member such as a screw passes through the corresponding mounting hole on the front housing 22 and the locking hole on the connecting columns 213 in turn, and then is locked in the locking hole of the connecting column 213, so as to fixedly connect the front housing 22 to the main housing 21. The main housing 21 is provided, at its front end, with a plurality of supporting columns 214 in the side wall of the air outlet channel 201 around the snapping ring 212. The supporting columns 214 are configured to connect the energy storage assembly 50 to the main housing 21. Specifically, each supporting column 214 is provided with a connecting hole 2140 along the axial direction of the main housing 21, and the energy storage assembly 50 is provided with fixing holes 5510 (as illustrated in FIG. 6) corresponding to the connecting holes 2140 on the supporting columns 214. In assembly, for each supporting column 214, a locking member such as a screw is inserted into the connecting hole 2140 of the supporting column 214 and the corresponding fixing hole 5510 on the energy storage assembly 50 in turn, and then locked in the corresponding fixing hole 5510, so as to fix the energy storage assembly 50 to the main housing 21. In this embodiment, the air outlet 211 includes a plurality of air outlet holes provided at the front end of the main housing 21. The plurality of air outlet holes are arranged along a circumferential direction of the snapping ring 212 for at least one circle. An inner side surface of the air outlet channel 201 is provided, near its rear end, with a plurality of positioning strips 216. The plurality of positioning strips 216 are configured for positioning the energy storage assembly 50. Specifically, the plurality of positioning strips 216 are arranged for one circle along the circumferential direction of the main housing 21.

Referring to FIG. 6 to FIG. 7 again, the front housing 22 defines a through hole 220 corresponding to the air outlet 211, and the front housing 22 is provided with a first adsorbing member 221 on its one end surface away from the main housing 21. In this embodiment, the first adsorbing member 221 is an annular structure. The first adsorbing member 221 is arranged on the end surface of the front housing 22 away from the main housing 21, and surrounds the through hole 220. The wireless blow dryer 100 further includes an air nozzle 70 detachably mounted on the front housing 22. Specifically, the air nozzle 70 includes an air nozzle housing 71 and a second adsorbing member 73. The second adsorbing member 73 is provided on an end surface of the air nozzle housing 71 facing the front housing 22. The air nozzle housing 71 defines an air outlet through hole 75 along its axial direction, and the second adsorbing member 73 is arranged around the air outlet through hole 75. When the air nozzle 70 is mounted on the air duct 20, the first adsorbing member 221 and the second adsorbing member 73 are adsorbed to each other, so that the air nozzle 70 is positioned on the air duct 20, and the air outlet through hole 75 communicates with the through hole 220. In this embodiment, both the first adsorbing member 221 and the second adsorbing member 73 are magnets.

In other embodiments, the first adsorbing member 221 is an iron ring, and the second adsorbing member 73 is a magnet. Alternatively, the first adsorbing member 221 is a magnet, and the second adsorbing member 73 is an iron ring.

In other embodiments, the first adsorbing member 221 is an electromagnet electrically coupled to the rechargeable batteries 51, and the second adsorbing member 73 is a magnet or an iron block. Specifically, in one of the embodiments, the first adsorbing member 221 is kept electrically coupled to the rechargeable batteries 51, to make the first adsorbing member 221 be able to maintain magnetic properties, so that the second adsorbing member 73 can be adsorbed to the first adsorbing member 221. In another embodiment, the wireless blow dryer 100 is further provided with a switch for controlling electrical coupling between the first adsorbing member 221 and the rechargeable batteries 51. When the air nozzle 70 is needed, the switch is turned on, so that the first adsorbing member 221 is energized and has magnetism, so as to realize the absorption connection between the first adsorbing member 221 and the second adsorbing member 73. When the air nozzle 70 needs to be removed, the switch is turned off to disconnect the electrical coupling between the first adsorbing member 221 and the rechargeable batteries 51, so that the first adsorbing member 221 is power off and the magnetism of the first adsorbing member 221 disappears, so as to facilitate the removal of the air nozzle 70.

The rear cover 24 is connected to the rear end of the main housing 21 to position the energy storage assembly 50 into the main housing 21. Specifically, the rear cover 24 includes a cover plate 241 and a flange 243 protruding from the edge of an end surface of the cover plate 241 facing the main housing 21. The cover plate 241 is provided, at its one end surface away from the main housing 21, with a plurality of counterbore holes 244. In assembly, a plurality of locking members such as screws passes through the counterbore holes 244 on the cover plate 241 and are locked to the rear end of the main housing 21, so as to fix the rear cover 24 to the rear end of the main housing 21. The flange 243 is provided, at its outer side surface, with a positioning slot 246 along its circumferential direction. The rear cover 24 further includes a sealing ring 247 received in the positioning slot 246 and a decorative sheet 248 attached to one end surface of the cover plate 241 away from the main housing 21. The sealing ring 247 is configured to seal the rear end of the air outlet channel 201 to prevent the airflow from flowing out of the air duct 20 through the rear end of the air duct 20, so as to ensure that the wind pressure of the airflow being out of the air duct 20 through the front end of the air duct 20 is not affected. The decoration sheet 248 is configured to decorate the appearance of the wireless blow dryer 100.

The handle 30 is provided with a wire slot 303 on its side wall, and the wires 53 are received in the wire slot 303, so as to prevent the wires 53 from occupying the space of the air inlet channel 301 of the handle 30, prevent the wires 53 from blocking part of the airflow, and make the air flow in the air inlet channel 301 smoother.

Referring to FIG. 1 to FIG. 7 again, in this embodiment, the handle 30 includes a handle body 31 connected to the air duct 20, a handle cover 33 detachably buckled on the handle body 31, and a hollow sleeve 35 sleeved on the outer surfaces of the handle body 31 and the handle cover 33. The handle body 31 is buckled with the handle cover 33 to form a cylindrical body. The fan assembly 60 is clamped between the handle body 31 and the handle cover 33, and the wires 53 are arranged between the sleeve 35 and the handle body 31 and/or the handle cover 33. Specifically, the handle body 31 is provided with a wire slot 303 on its outer peripheral surface. The wire slot 303 extends from one end of the handle body 31 to the other end of the handle body 31 along the length direction of the handle body 31. The wires 53 are received in the wire slot 303, and the sleeve 35 is sleeved on the handle body 31 to position the wires 53.

In other embodiments, the handle cover 33 may also be provided with a wire slot on its outer peripheral surface. The wire slot extends from one end of the handle cover 33 to an opposite end of the handle cover 33. The wires 53 are received in the wire slot, and the sleeve 35 is sleeved on the handle cover 33 to position the wires 53.

In other embodiments, the inner side surface of the handle body 31 and/or the handle cover 33 is provided with a wire slot along the extending direction of the air inlet channel 301, and the wires 53 are clamped in the wire slot.

In other embodiments, the side wall of the handle body 31 and/or the handle cover 33 is provided with a wire slot along the extending direction of the air inlet channel 301, and the wires 53 are inserted into the wire slot.

As illustrated in FIG. 4 to FIG. 7, in this embodiment, a radial cross section of the handle body 31 is in a semicircular ring shape. The handle body 31 is provided, on its inner side surface, with a positioning groove 312 at its one end away from the main housing 21. The positioning groove 312 is configured to receive and position the fan assembly 60. The handle body 31 is provided, at a position of its one side wall connected to the handle cover 33, with a plurality of connecting holes 314. The handle body 31 is provided with a tail frame 311 at its free end. The tail frame 311 is provided with an air inlet 315 communicating with the air inlet channel 301, that is, the air inlet 315 is located at one end of the handle body 31 away from the main housing 21. The tail frame 311 is provided with clamping holes 3110 on its one side surface facing the handle cover 33. The handle body 31 is provided, on its inner side surface, with a first control switch 316 and a second control switch 317 at a position close to the main housing 21. The first control switch 316 is configured to control the wind volume caused by the fan assembly 60, and the second control switch 317 is configured to control working states of the electric heating assembly 80, that is, to control the electric heating assembly 80 to generate heat. The first control switch 316 and the second control switch 317 are respectively driven by a toggle button 318, so as to realize the operation of the first control switch 316 and the second control switch 317. Specifically, the handle body 31 is provided, on its outer side surface, with sliding slots 319 spaced apart from each other at positions corresponding to the first control switch 316 and the second control switch 317, respectively. Two toggle buttons 318 are respectively inserted into the corresponding sliding slots 319 and connected to the first control switch 316 and the second control switch 317.

Figure 10:
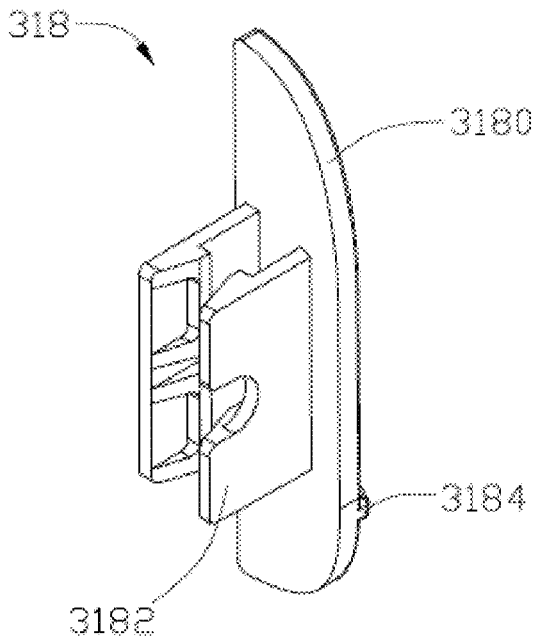
FIG. 10 is an enlarged view of a toggle button of the wireless blow dryer illustrated in FIG. 7.

As illustrated in FIG. 10, each toggle button 318 includes a toggle piece 3180, two spaced guiding hooks 3182 arranged on one side surface of the toggle piece 3180, and anti-slip strips 3184 arranged on an opposite side surface of the toggle piece 3180. The two sliding guiding hooks 3182 are respectively inserted into the corresponding sliding slots 319 on the handle body 31, so that the toggle button 318 is slidably connected to the handle body 31 through the sliding slot 319, and the two toggle buttons 318 are respectively connected to the first control switch 316 and the second control switch 317. The anti-slip strips 3184 are configured to facilitate operation of the toggle button 318 by user.

Please refer to FIG. 4 to FIG. 7 again, the structure of the handle cover 33 is similar to that of the handle body 31. Specifically, a radial cross section of the handle cover 33 is in a semicircular shape. The handle cover 33 is provided, on its inner side surface, with a positioning groove 332 at its one end away from the main housing 21. The positioning groove 332 is configured to receive and position the fan assembly 60. The handle cover 33 is provided, at a position of its one side wall connected to the handle body 31, with a plurality of through holes 334 corresponding to the connecting holes 314 defined on the handle body 31. The handle cover 33 is provided with a tail frame 331 at its free end. The tail frame 331 is provided with an air inlet 335 communicating with the air inlet channel 301, that is, the air inlet 335 is located at one end of the handle cover 33 away from the main housing 21. The tail frame 331 is provided with clamping blocks 3310 on its one side surface facing the handle body 31. When the handle body 31 and the handle cover 33 are buckled together, the clamping blocks 3310 on the tail frame 331 are respectively clamped into the corresponding clamping holes 3110 on the tail frame 311. Locking members such as screws pass through the through hole 334 on the handle cover 33 and the corresponding connecting hole 314 on the handle body 31 in turn, and then are locked in the corresponding connecting holes 314, so as to fix the handle body 31 and the handle cover 33 together, the fan assembly 60 is clamped between the handle body 31 and the handle cover 33, and the air inlet 315 of the tail frame 311 communicates with the air inlet 335 of the tail frame 331 to form a complete air inlet. The handle cover 33 is provided with two abutting pieces 336 on its inner side surface close to the main housing 21. The two abutting pieces 336 are configured to abut the first control switch 316 and the second control switch 317. The extending direction of each abutting piece 336 is parallel to the extending direction of the air inlet channel 301, so as to reduce the obstruction of the abutting pieces 336 to the airflow. In other embodiments, the abutting piece 336 can also be omitted, or abutting needles can be used to replace the abutting pieces 336, so as to further reduce the obstruction to the airflow.

Figure 1:
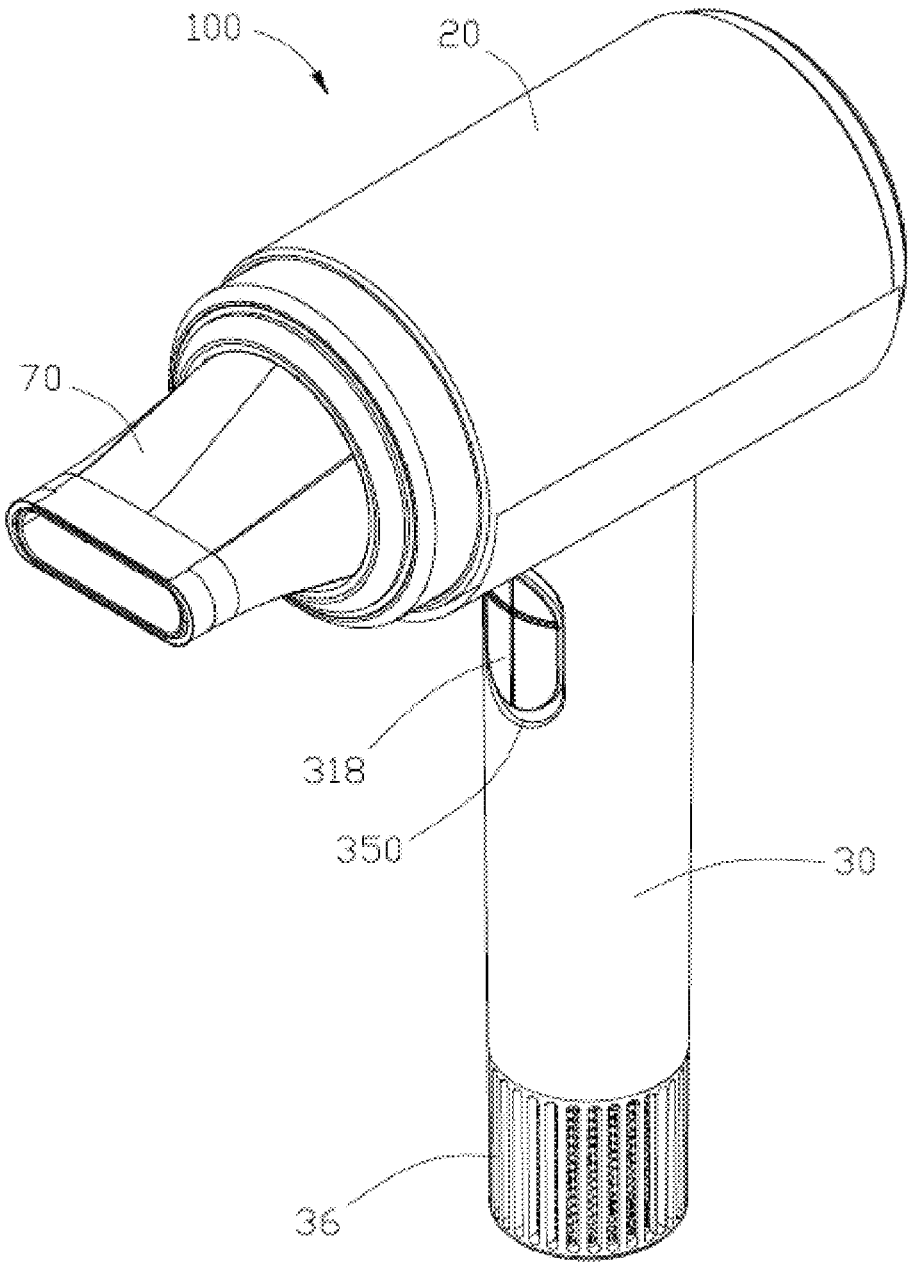
FIG. 1 is a schematic diagram of a three-dimensional structure of a wireless blow dryer according to an embodiment of the present disclosure.
Figure 2:
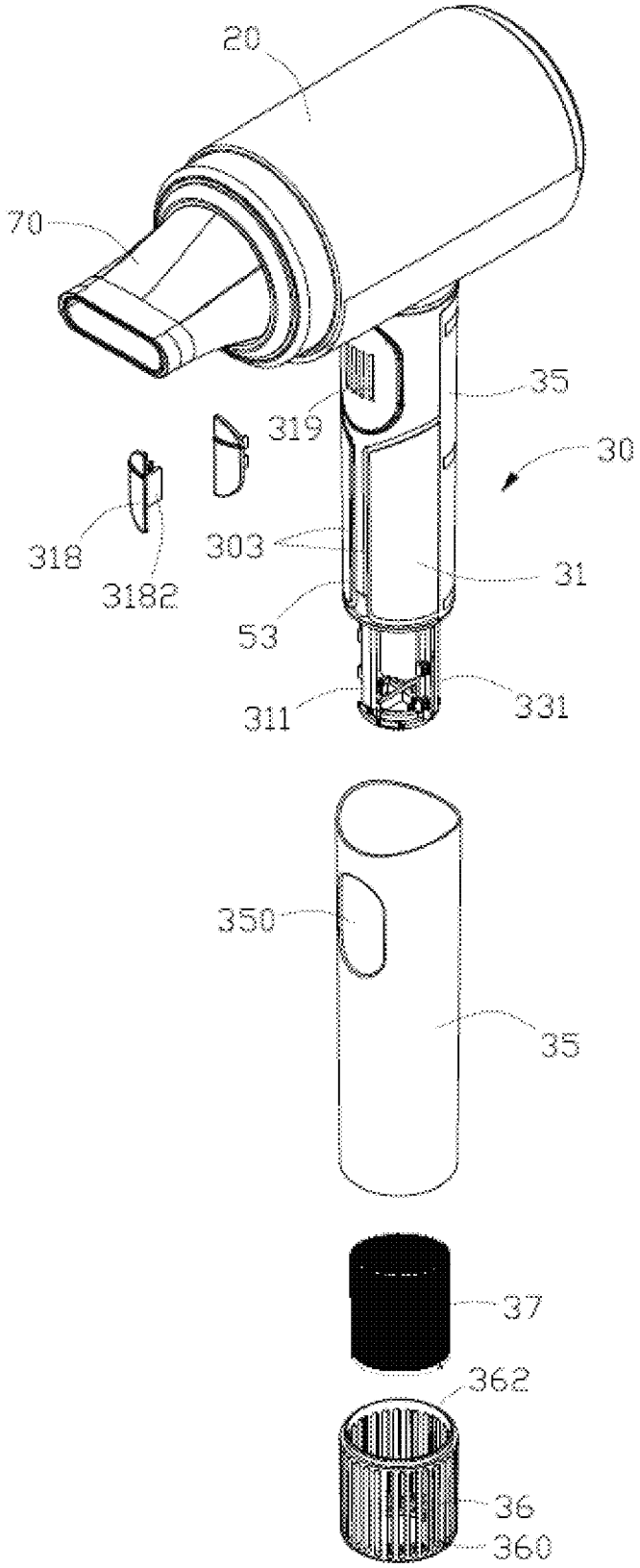
FIG. 2 is a partial exploded schematic diagram of the three-dimensional structure of a handle of the wireless blow dryer illustrated in FIG. 1.
Figure 3:
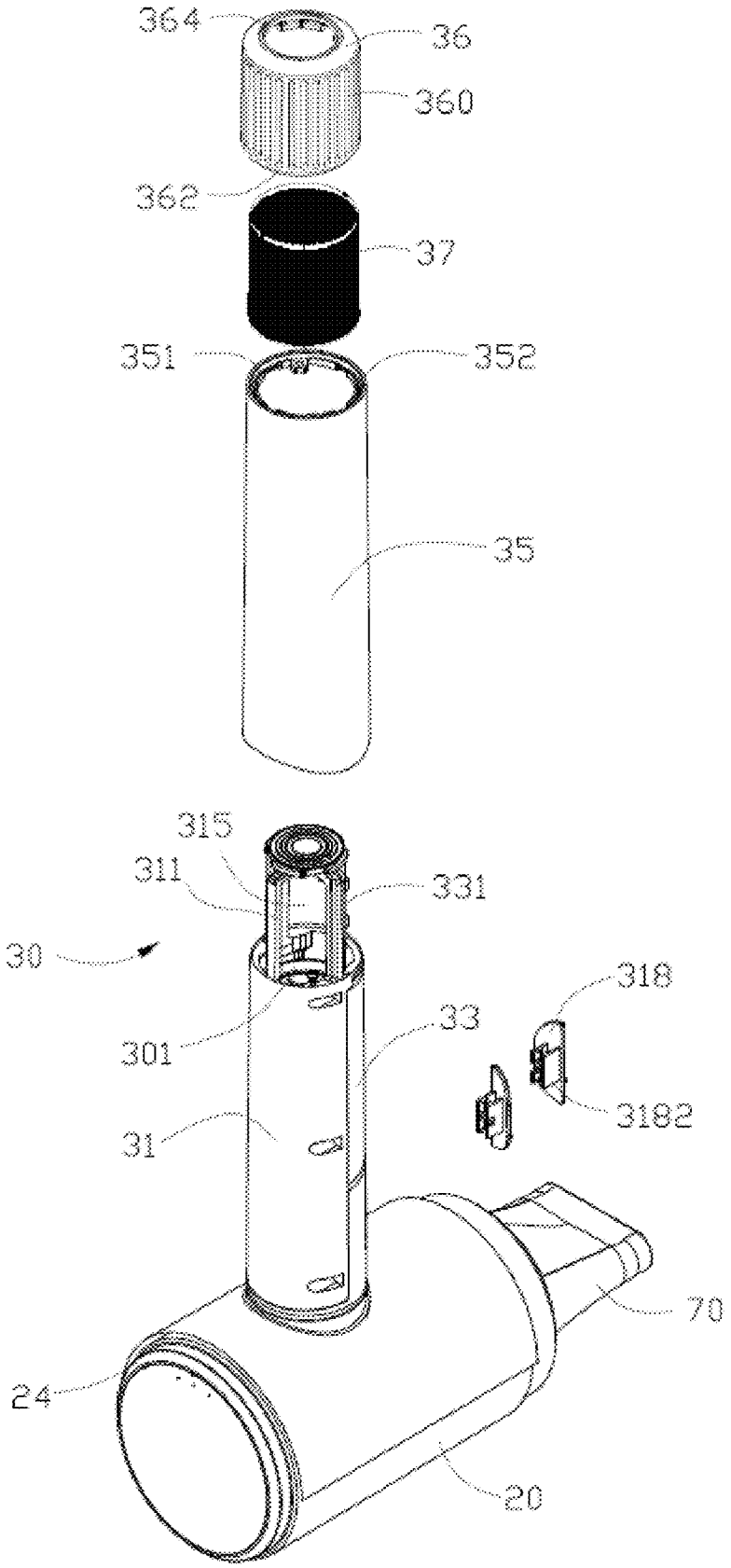
FIG. 3 is a schematic diagram of the three-dimensional structure of the wireless blow dryer illustrated in FIG. 2 from another perspective.

Please refer to FIG. 2 and FIG. 3 again, the sleeve 35 is provided, on its side wall, with a guiding groove 350 communicating with an inner cavity of the sleeve 35 and corresponding to the toggle button 318. The toggle button 318 is able to slide in the guiding groove 350. The sleeve 35 is provided with a connecting ring 351 on its one end surface away from the main housing 21. The connecting ring 351 is provided with a clamping slot 352 along the circumferential direction of the sleeve 35.

The handle 30 further includes a tail cover 36. The tail cover 36 is detachably connected to a free end of the handle body 31 and/or a free end of the handle cover 33. The tail cover 36 is provided with a plurality of air holes 360. When the tail cover 36 is connected to the handle body 31 and/or the handle cover 33, the air holes 360 communicate with the air inlets 315 and 335. Specifically, the tail cover 36 has a cylindrical structure, and the tail cover 36 is provided with a plurality of strip-shaped air holes 360 on its side wall. The air holes 360 are arranged along the circumferential direction of the tail cover 36, and extend along the axial direction of the tail cover 36. Preferably, the air holes 360 are arranged at even intervals along the circumferential direction of the tail cover 36. The air hole 360 is configured to allow the outside air to enter the air inlets 315 and 335 from the air holes 360 on the tail cover 36, and then enter the air inlet channel 301. In this embodiment, the tail cover 36 is detachably sleeved on the outer surface of the tail frame 311 of the handle body 31 and the tail frame 331 of the handle cover 33, and is detachably connected with a tail end of the sleeve 35. Specifically, the tail cover 36 is provided with a clamping strip 362 on its one end surface facing the sleeve 35. The clamping strip 362 is arranged along the circumferential direction of the tail cover 36. The clamping strip 362 of the tail cover 36 is detachably clamped into the clamping slot 352 of the sleeve 35, so as to connect the tail cover 36 to the tail end of the sleeve 35. The tail cover 36 is provided with a mounting hole 364 at its one end away from the clamping strip 362, and the mounting hole 364 is configured to fix the charging connector 52.

Figure 12:
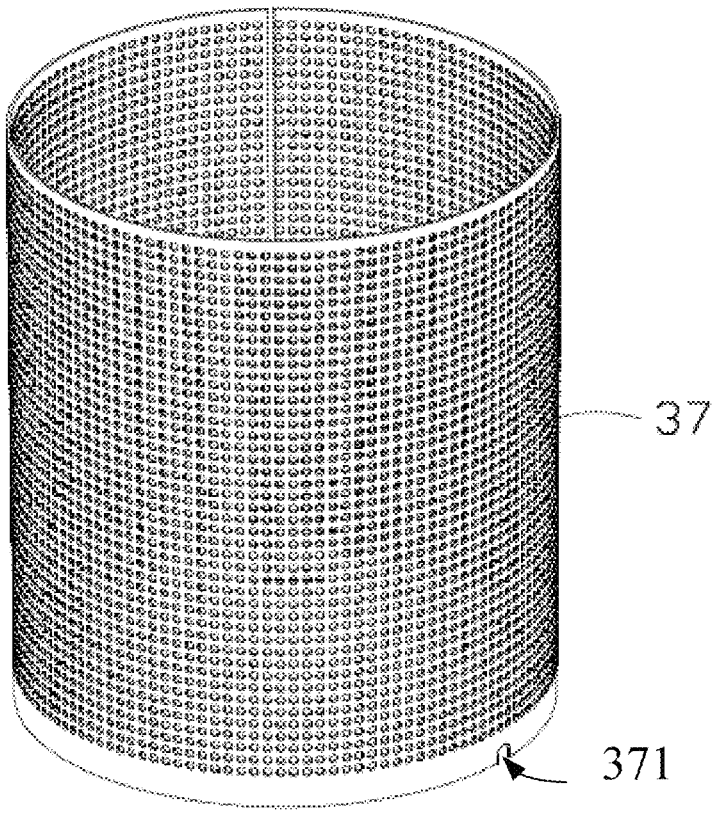
FIG. 12 is an enlarged view of a filter mesh of the wireless blow dryer illustrated in FIG. 2.
Figure 13:
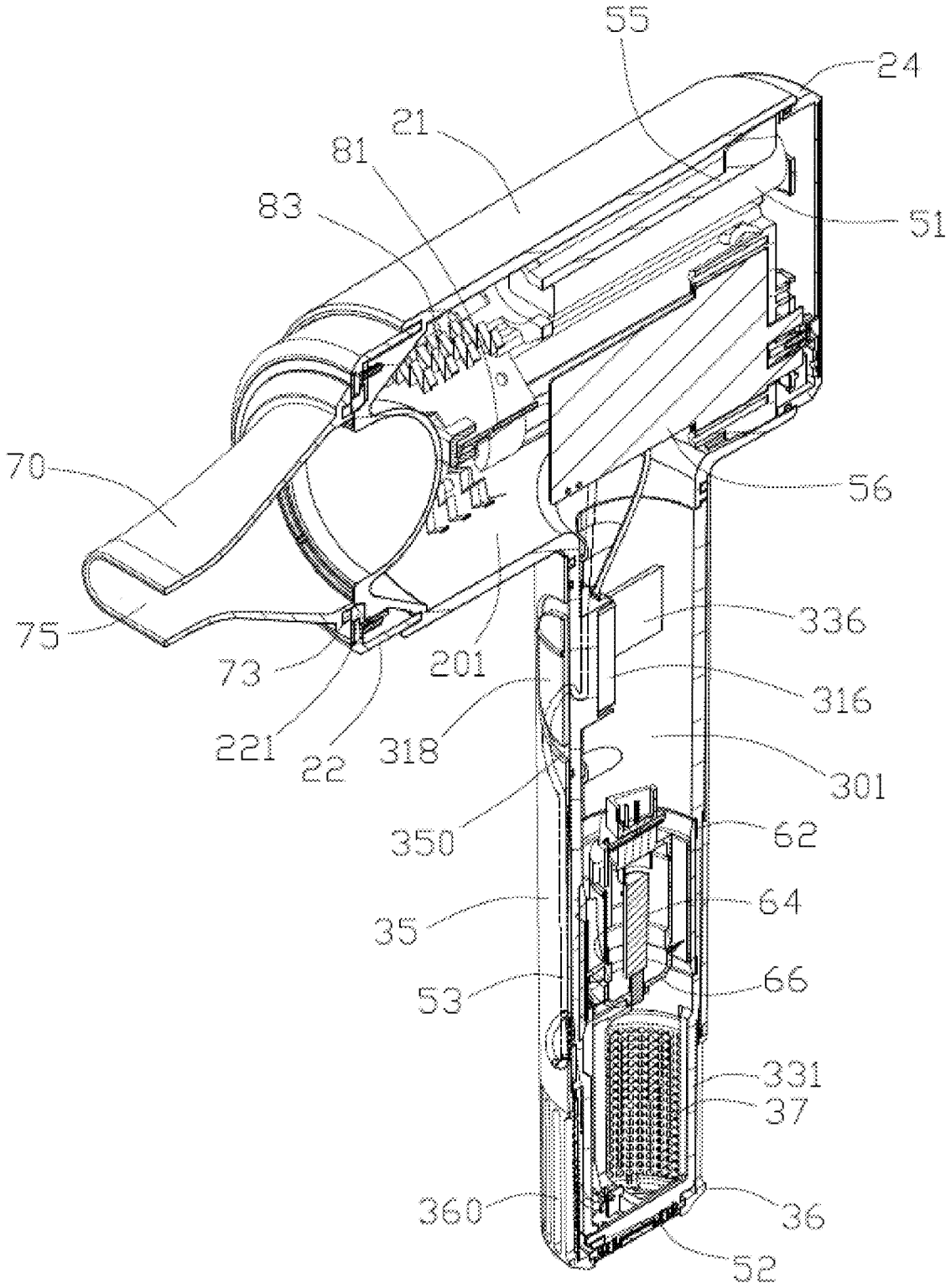
FIG. 13 is a perspective cross-sectional view of the wireless blow dryer illustrated in FIG. 1.

Preferably, the wireless blow dryer 100 further includes a detachable filter mesh 37 arranged between the tail cover 36 and the handle body 31 and/or the handle cover 33. The filter mesh 37 has a cylindrical structure. In this embodiment, the filter mesh 37 is detachably arranged between the tail cover 36 and the tail frame 311 of the handle body 31 and the tail frame 331 of the handle cover 33. The filter mesh 37 is configured to filter dust contained in the airflow entering the air inlets 315 and 335. As illustrated in FIG. 12, the filter mesh 37 is provided with a notch 371 on its one end portion. The notch 371 is clamped to a positioning protrusion (not illustrated) provided on the tail cover 36, so that the filter mesh 37 is positioned in the tail cover 36. In other embodiments, the notch 371 of the filter mesh 37 can also be clamped to a positioning protrusion (not illustrated) provided on the tail frame 311 of the handle body 31 or the tail frame 331 of the handle cover 33, so that the filter mesh 37 is positioned on the handle body 31 or the handle cover 33.

Figure 11:
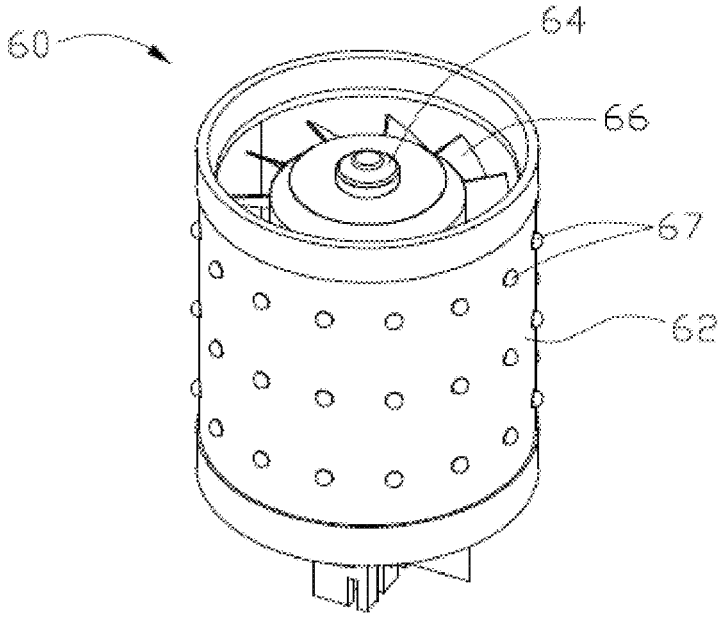
FIG. 11 is an enlarged view of a fan assembly of the wireless blow dryer illustrated in FIG. 7.

Please refer to FIG. 11, the fan assembly 60 includes a positioning cylinder 62, a motor 64 arranged in the positioning cylinder 62, and a fan blade 66 connected to the motor 64. When the positioning cylinder 62 is clamped between the handle body 31 and the handle cover 33, a rotation axis of the fan blade 66 is collinear with an axis center line of the air inlet channel 301. The positioning cylinder 62 is provided with a plurality of positioning protrusions 67 on its outer peripheral surface. The plurality of positioning protrusions 67 abut against the inner peripheral surface of the handle body 31 and the inner peripheral surface of the handle cover 33, so that the fan assembly 60 is able to be positioned in the handle 30.

Please refer to FIG. 6 and FIG. 7, the energy storage assembly 50 further includes a cell bracket 55 for mounting the plurality of rechargeable batteries 51. The plurality of rechargeable batteries 51 are arranged along the circumferential direction of the cell bracket 55. The cell bracket 55 includes a plurality of supporting columns 551 arranged along its circumferential direction and extending along its axial direction. The plurality of supporting columns 551 correspond to the plurality of supporting columns 214 of the main housing 21 one by one. Each supporting column 551 is provided with a fixing hole 5510 at its one end along the axial direction of the supporting column 551. In assembly, for each supporting column 551 and its corresponding supporting column 214, a locking member such as a screw is inserted into the connecting hole 2140 on the supporting column 214 and the corresponding fixing hole 5510 on the supporting column 551 in turn, and then locked in the corresponding fixing hole 5510, so as to fix the cell bracket 55 to the main housing 21. The wireless blow dryer 100 further includes a main control board 56. The main control board 56 is electrically coupled to the rechargeable batteries 51, the fan assembly 60, the charging connector 52, the first control switch 316 and the second control switch 317. The main control board 56 is configured to control the charging of the rechargeable battery 51 and the rotation of the motor 64.

The electric heating assembly 80 is located at one end of the energy storage assembly 50. Specifically, the electric heating assembly 80 includes a heating wire bracket 81 connected to the cell bracket 55, and heating wires 83 wound on the heating wire bracket 81. The heating wires 83 are electrically coupled to the main control board 56. The rechargeable batteries 51 provide electric energy to the motor 64, the heating wire 83 and the main control board 56.

Please refer to FIG. 4 to FIG. 9 and FIG. 13 together, when assembling the wireless blow dryer 100, a combination of the energy storage assembly 50 and the electric heating assembly 80 is placed in the air outlet channel 201 of the main housing 21, so that the plurality of supporting columns 551 on the energy storage assembly 50 and the plurality of supporting columns 214 on the main housing 21 are connected one by one. A plurality of locking members such as screws are respectively inserted into the connecting holes 2140 on the supporting columns 214 and the corresponding fixing hole 5510 on the energy storage assembly 50, and then locked in the corresponding fixing holes 5510, so that the energy storage assembly 50 and the electric heating assembly 80 are fixed to the main housing 21. At this time, the electric heating assembly 80 is located in the air outlet channel 201 and is close to the air outlet 211 of the main housing 21. The energy storage assembly 50 and the main control board 56 are located at one end of the air outlet channel 201 away from the air outlet 211, and one end of the energy storage assembly 50 and one end of the main control board 56 that are close to the electric heating assembly 80 face the air inlet channel 301. In this way, when the airflow caused by the operation of the fan assembly 60 flows from the air inlet channel 301 to the air outlet channel 201, at least part of the airflow passes through the rechargeable batteries 51 and the main control board 56, then passes through the electric heating assembly 80, and finally is discharged through the air outlet 211. Another part of the airflow directly passes through the electric heating assembly 80 from the air inlet channel 301 and is discharged from the air outlet 211. It is understandable that during the use of the wireless blow dryer 100, since part of the airflow flowing from the air inlet channel 301 to the air outlet channel 201 passes through the rechargeable batteries 51 and the main control board 56, then passes through the electric heating assembly 80, and finally is discharged through the air outlet 211. Therefore, the heat generated by the rechargeable batteries 51 and the main control board 56 during their operation is dissipated in time by the airflow flowing from the air inlet channel 301 to the air outlet channel 201, which makes the wireless blow dryer 100 work more stable and prevents the rechargeable batteries 51 and the main control board 56 from being damaged due to excessive temperature, thereby improving the service life of the wireless blow dryer 100.

The sealing ring 247 is sleeved in the positioning slot 246 on the rear cover 24, and the rear cover 24 is mounted to the rear end of the main housing 21 until the flange 243 on the rear cover 24 abuts the positioning strips 216 on the main housing 21. Then, a plurality of locking members are inserted into the counterbore holes 244 on the rear cover 24 and locked to the cell bracket 55, so that the rear cover 24 is fixed to the main housing 21 through the cell bracket 55, thereby encapsulating the energy storage assembly 50 and the electric heating assembly 80 into the main housing 21.

Figure 14:
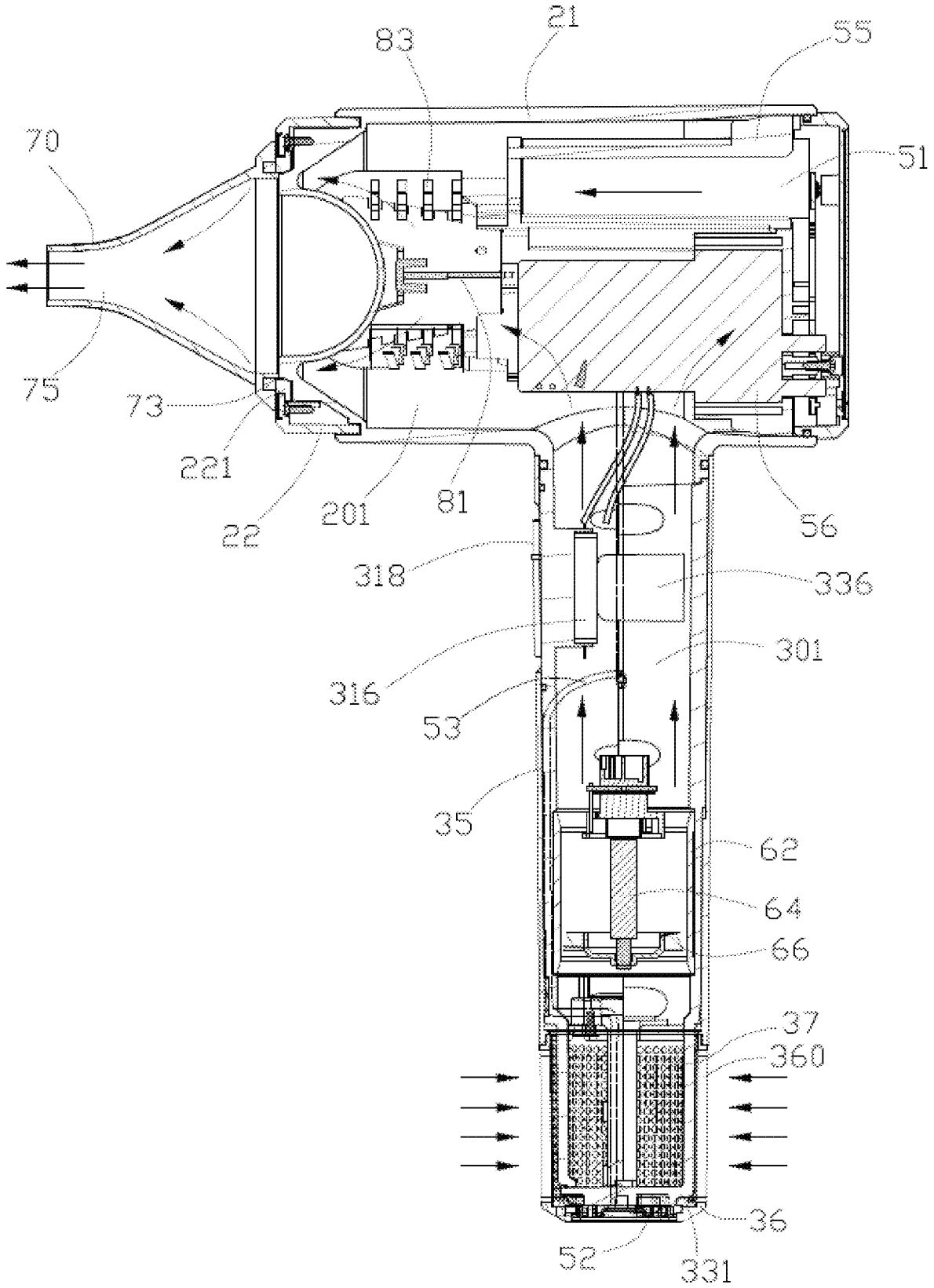
FIG. 14 is a schematic diagram of flow directions of internal airflow in the wireless blow dryer illustrated in FIG. 1 when the wireless blow dryer is in use.

The front housing 22 is mounted at the front end of the main housing 21. Specifically, the front housing 22 is sleeved on the snapping ring 212 of the main housing 21, and a plurality of locking members such as screws pass through the mounting holes defined on the front housing 22 and the corresponding locking holes defined on the connecting columns 213, and then are locked in corresponding locking holes of the connecting columns 213, so as to fixedly connect the front housing 22 to the main housing 21. [48] The fan assembly 60 is mounted into the handle 30. Specifically, part of the structure of the positioning cylinder 62 of the fan assembly 60 is received in the positioning groove 312 of the handle body 31, and then the handle cover 33 is buckled onto the handle body 31 to make the other part of the structure of the positioning cylinder 62 be received in the positioning groove 332 of the handle cover 33. The clamping blocks 3310 of the tail frame 331 are respectively clamped into the corresponding clamping holes 3110 on the tail frame 311. A plurality of locking members such as screws are respectively inserted into the plurality of through holes 334 defined on the handle cover 33 and the corresponding connecting holes 314 defined on the handle body 31, and then locked in the corresponding connecting holes 314, so that the handle body 31 and the handle cover 33 are fixed together, the fan assembly 60 is clamped between the handle body 31 and the handle cover 33, and the rotation axis of the fan blade 66 of the fan assembly 60 is collinear with the axis line of the handle 30. That is, the center line of the air inlet channel 301 is collinear with the rotation axis of the fan blade 66, and the abutting piece 336 of the handle cover 33 abuts the first control switch 316 and the second control switch 317, respectively. The wires 53 are received in the wire slot 303 of the handle body 31, and the sleeve 35 is sleeved on the handle body 31 and the handle cover 33 until the guiding groove 350 defined on the sleeve 35 faces the sliding slot 319 defined on the handle body 31. The guiding hooks 3182 of the two toggle buttons 318 are respectively inserted into the corresponding sliding slots 319 and connected to the first control switch 316 and the second control switch 317. The charging connector 52 is received in the mounting hole 364 of the tail cover 36, and the filter mesh 37 is attached to the inner side surface of the tail cover 36. Then the tail cover 36 is connected to the tail end of the sleeve 35. Specifically, the tail cover 36 is sleeved on the tail frames 311 and 331, and the camping strip 362 of the tail cover 36 is clamped in the clamping slot 352 of the sleeve 35. At this time, the sleeve 35 is exposed outside the air inlets 315 and 335, and the air hole 360 on the tail cover 36, the through hole on the filter mesh 37 and the air inlets 315 and 335 are in communication with each other. [49] As illustrated in FIG. 14, when the wireless blow dryer 100 is in use, the air nozzle 70 is mounted to the front end of the air duct 20 through the front housing 22, that is, the second adsorbing member 73 of the air nozzle 70 and the first adsorbing member 221 on the front housing 22 are positioned by being adsorbed to each other, and the air through hole 75 communicates with the through hole 220 of the front housing 22. The toggle button 318 is operated to trigger the first control switch 316, and then the first control switch 316 sends a signal to the main control board 56. The main control board 56 receives the signal and controls the motor 64 to work to drive the fan blade 66 to rotate, so as to cause airflow to pass through the filter mesh 37 from the air inlet hole 360 of the tail cover 36, then enter the air inlet channel 301, and then exits through the air outlet channel 201, the air outlet 211, the air hole 220 and the air outlet through hole 75. When the wind volume of the wireless blow dryer 100 needs to be adjusted, it is only need to slide the toggle button 318 to connect the first control switch 316 to different gears, and then the main control board 56 controls the power of the motor 64 to adjust the rotation speed of the fan blade 66, so as to realize the adjustment of the wind volume. When hot air is needed, the toggle button 318 is operated to trigger the second control switch 317, then the second control switch 317 sends a signal to the main control board 56. The main control board 56 receives the signal and controls the heating wires 83 to generate heat. When the airflow passes through the heating wire 83, heat exchange occurs with it, so that the wireless blow dryer 100 blows out hot air. In addition, the heating power of the heating wires 83 can also be adjusted by operating the second control switch 317, so as to meet users' needs for hot airflow of different temperatures.

Preferably, the main control board 56 is further provided with a battery protection circuit module (not illustrated), which is configured to effectively protect the rechargeable battery 51 in the air duct 20, that is, provide over-charge protection, over-discharge protection, over-current protection, and short-circuit protection, etc., for the rechargeable battery 51.

Preferably, the wireless blow dryer 100 is further provided with a display module (not illustrated) electrically coupled to the main control board 56. The display module is configured to display a working status of the wireless blow dryer 100, and the user can know the working status of the wireless blow dryer 100 in time by observing the display module.

The above is the embodiments of the present disclosure. It should be noted that for those of ordinary skill in the art, several improvements and modifications can be made without departing from the principles of the embodiments of the present disclosure. These improvements and modifications are also considered as the protection scope of the present disclosure.

What is claimed is:

1. A wireless blow dryer comprising:

an air duct;

a handle connected to the air duct;

an energy storage assembly comprising at least one energy storage module arranged in the air duct;

a fan assembly; and an air inlet channel and an air outlet channel communicating with each other; wherein the air duct is provided with the air outlet channel;

wherein the energy storage assembly is located at one end of the air outlet channel away from an air outlet of the air duct, the fan assembly is arranged in the air inlet channel, and is configured to cause airflow to enter the air inlet channel and out of the air duct through the air outlet channel, and at least part of the airflow entering from the air inlet channel passes through the energy storage assembly and then exits the air duct through the air outlet channel.

2. The wireless blow dryer of claim 1, wherein the handle is provided with the air inlet channel;

wherein the energy storage assembly further comprises:

a charging connector arranged at a free end of the handle; and wires coupled between the energy storage module and the charging connector, wherein the wires are arranged in a side wall of the handle.

3. The wireless blow dryer of claim 2, wherein the handle is provided with a wire slot on the side wall of the handle, and the wires are received in the wire slot.

4. The wireless blow dryer of claim 2, wherein the handle comprises a handle body connected to the air duct, a handle cover detachably buckled on the handle body, and a hollow sleeve sleeved on the outer surfaces of the handle body and the handle cover; the fan assembly is clamped between the handle body and the handle cover, and the wires are arranged between the sleeve and at least one of the handle body and the handle cover.

5. The wireless blow dryer of claim 4, wherein at least one of the handle body and the handle cover is provided with a wire slot on an outer peripheral surface of the handle cover; wherein the wires are received in the wire slot, and the sleeve is sleeved on the handle body and the handle cover to position the wires.

6. The wireless blow dryer of claim 4, wherein each of the handle body and the handle cover is provided, on an inner side surface of each of the handle body and the handle cover, with a positioning groove at one end of each of the handle body and the handle cover away from the air duct, wherein the positioning groove is configured to receive and position the fan assembly.

7. The wireless blow dryer of claim 4, wherein the handle body is provided, at a position of a side wall of the handle body connected to the handle cover, with a plurality of connecting holes;

the handle cover is provided, at a position of a side wall of the handle cover connected to the handle body, with a plurality of through holes corresponding to the connecting holes defined on the handle body;

wherein when the handle body and the handle cover are buckled together, locking members pass through the through holes on the handle cover and corresponding connecting hole on the handle body in turn, and then are locked in the corresponding connecting hole, so as to fix the handle body and the handle cover together.

8. The wireless blow dryer of claim 4, wherein each of the handle body and the handle cover is provided with a tail frame at a free end of the handle cover, wherein the tail frame is provided with an air inlet communicating with the air inlet channel;

wherein when the handle body and the handle cover are buckled together, the air inlet of the tail frame of the handle body communicates with the air inlet of the tail frame of the handle cover to form a complete air inlet.

9. The wireless blow dryer of claim 8, wherein the tail frame of the handle body is provided with clamping holes on one side surface of the tail frame of the handle body facing the handle cover;

the tail frame of the handle cover is provided with clamping blocks on one side surface of the tail frame of the handle cover facing the handle body;

wherein when the handle body and the handle cover are buckled together, the clamping blocks are respectively clamped into the corresponding clamping holes.

10. The wireless blow dryer of claim 4, wherein the handle further comprises a tail cover provided with air holes, wherein the tail cover is detachably connected to free ends of the handle body and handle cover;

wherein at least one of the handle body and the handle cover is provided with an air inlet at a free end of at least one of the handle body and the handle cover, wherein the sleeve is exposed outside the air inlet, and the air holes communicate with the air inlet.

11. The wireless blow dryer of claim 10, wherein the tail cover is detachably sleeved on the outer surface of the free ends of the handle body and the handle cover, and is detachably connected with a tail end of the sleeve.

12. The wireless blow dryer of claim 11, wherein the sleeve is provided with a connecting ring on one end surface of the sleeve away from the air duct, wherein the connecting ring is provided with a clamping slot along a circumferential direction of the sleeve;

the tail cover is provided with a clamping strip on one end surface of the tail cover facing the sleeve, wherein the clamping strip is arranged along the circumferential direction of the tail cover wherein the clamping strip of the tail cover is detachably clamped into the clamping slot of the sleeve, so as to connect the tail cover to the tail end of the sleeve.

13. The wireless blow dryer of claim 12, wherein the tail cover is provided with a mounting hole at one end of the tail cover away from the clamping strip, wherein the mounting hole is configured to fix the charging connector.

14. The wireless blow dryer of claim 10, wherein the wireless blow dryer further comprises a detachable filter mesh arranged between the tail cover and the handle body and/or the handle cover.

15. The wireless blow dryer of claim 4, wherein the fan assembly comprises a positioning cylinder, a motor arranged in the positioning cylinder, and a fan blade connected to the motor, wherein the positioning cylinder is clamped between the handle body and the handle cover, and a rotation axis of the fan blade is collinear with the an axis center line of the air inlet channel.

16. The wireless blow dryer of claim 15, wherein the positioning cylinder is provided with a plurality of positioning protrusions on an outer peripheral surface of the positioning cylinder, wherein the plurality of positioning protrusions is configured to abut against an inner peripheral surface of the handle body and an inner peripheral surface of the handle cover, so that the fan assembly is able to be positioned in the handle.

17. The wireless blow dryer of claim 1, wherein the wireless blow dryer further comprises an electric heating assembly arranged in the air outlet channel, wherein the electric heating assembly is located at one end of the energy storage assembly; wherein the airflow caused by an operation of the fan assembly passes through the energy storage assembly, then passes through the electric heating assembly, and finally is discharged from the air outlet channel.

18. The wireless blow dryer of claim 17, wherein the wireless blow dryer further comprises a main control board arranged in the air outlet channel, wherein the air flow caused by the operation of the fan assembly is discharged from the air outlet channel after passing through the main control board.

19. The wireless blow dryer of claim 18, wherein the electric heating assembly is located in the air outlet channel close to an air outlet of the air duct, wherein the main control board is located at one end of the air outlet channel away from the air outlet, and an end of the energy storage assembly and an end of the main control board that are close to the electric heating assembly face the air inlet channel.

20. The wireless blow dryer of claim 1, wherein the air duct comprises a main housing; the main housing is provided with an air guiding element at a front end of the air outlet channel adjacent to the air outlet; the air guiding element is a hemispherical structure that is provided at a front end of the main housing and is concave toward a rear end of the main housing along an axial direction of the main housing in the air outlet channel.

* * * * *